US009033032B2

(12) United States Patent
Umphries et al.

(10) Patent No.: US 9,033,032 B2
(45) Date of Patent: May 19, 2015

(54) WIRELESS DOWNHOLE TOOL POSITIONING CONTROL

(76) Inventors: Don Umphries, New Iberia, LA (US); Gabe Williger, Dallas, TX (US)

( * ) Notice: Subject to any disclaimer, the term of this patent is extended or adjusted under 35 U.S.C. 154(b) by 378 days.

(21) Appl. No.: 13/507,377

(22) Filed: Jun. 23, 2012

(65) Prior Publication Data

US 2013/0341007 A1 Dec. 26, 2013

(51) Int. Cl.

| | |
|---|---|
| ***E21B 17/00*** | (2006.01) |
| ***E21B 17/10*** | (2006.01) |
| ***E21B 23/08*** | (2006.01) |

(52) U.S. Cl.

CPC ..... *E21B 17/1028* (2013.01); *E21B 23/08* (2013.01)

(58) Field of Classification Search

CPC ..... E21B 17/1028; E21B 23/08

USPC ..... 166/244.1, 172, 202

See application file for complete search history.

(56) References Cited

U.S. PATENT DOCUMENTS

| | | | | | |
|---|---|---|---|---|---|
| 1,412,213 | A | * | 4/1922 | Mowers | 417/552 |
| 1,527,956 | A | * | 2/1925 | Mowers | 417/53 |
| 2,344,120 | A | * | 3/1944 | Baker | 166/289 |
| 2,888,079 | A | * | 5/1959 | Cypher | 166/139 |
| 2,929,455 | A | * | 3/1960 | Godbey | 166/67 |
| 3,163,038 | A | * | 12/1964 | Bryant | 73/152.34 |
| 3,891,034 | A | * | 6/1975 | Owen et al. | 166/285 |
| 6,564,686 | B1 | | 5/2003 | Keeling et al. | |
| 6,722,251 | B2 | | 4/2004 | Keeling et al. | |
| 7,258,054 | B1 | | 8/2007 | Keeling et al. | |
| 8,066,066 | B2 | | 11/2011 | Linaker | |
| 2011/0127046 | A1 | | 6/2011 | Aguirre et al. | |
| 2011/0290474 | A1 | | 12/2011 | Nutley | |

* cited by examiner

*Primary Examiner* — Robert E Fuller

(74) *Attorney, Agent, or Firm* — W. Allen Marcontell

(57) ABSTRACT

For a free falling well tool sub having one or more pipe bore centering cages, a collapsible material cone secured inside of the centering cage half length with the cone base opening in the downhole direction restricts the rate of pipe bore fluid flow past the cone and thereby restricts the descent rate of the tool. The rate of descent may be regulated with fluid flow by-pass apertures in the sub. A collapsible material cone in a bore centering cage having a base opening in the up-hole direction may be used as piston to drive the tool sub along horizontal segments of a deviated well bore. Both cones may be used separately or together.

14 Claims, 4 Drawing Sheets

WIRELESS DOWNHOLE TOOL POSITIONING CONTROL

CROSS-REFERENCE TO RELATED APPLICATION

Not applicable

BACKGROUND OF THE INVENTION

Field of the Invention

The present invention relates to deep well operations controlled or initiated by free falling tool subs.

SUMMARY OF THE INVENTION

A cone of flexible material is secured within one or both of the centering spring cages of a free falling well tool connected to or part of a perforating gun, tubing cutter or well logging sensor or similar well tool. In a first operational mode, the invention is preferably utilized to regulate the descent rate of the free falling tool in substantially vertical segments of a well length. In a second operational mode, the invention is a process and tool for driving a well tool along deviated and horizontal segments of a well length where gravity forces are insufficient to sustain displacement. In the second mode, the cone opens against up-hole fluid pressure to drive the tool along deviated, substantially horizontal length segments of a well. The second mode cone also collapses to permit the free by-pass flow of standing well fluid when free falling in vertical length segments of the well.

BRIEF DESCRIPTION OF THE DRAWINGS

The invention is hereafter described in detail and with reference to the drawings wherein like reference characters designate like or similar elements throughout the several figures and views that collectively comprise the drawings. Respective to each drawing figure.

DESCRIPTION OF THE PREFERRED EMBODIMENTS

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figures 1A, 1B, 1C, 1D, 1E, 1F:
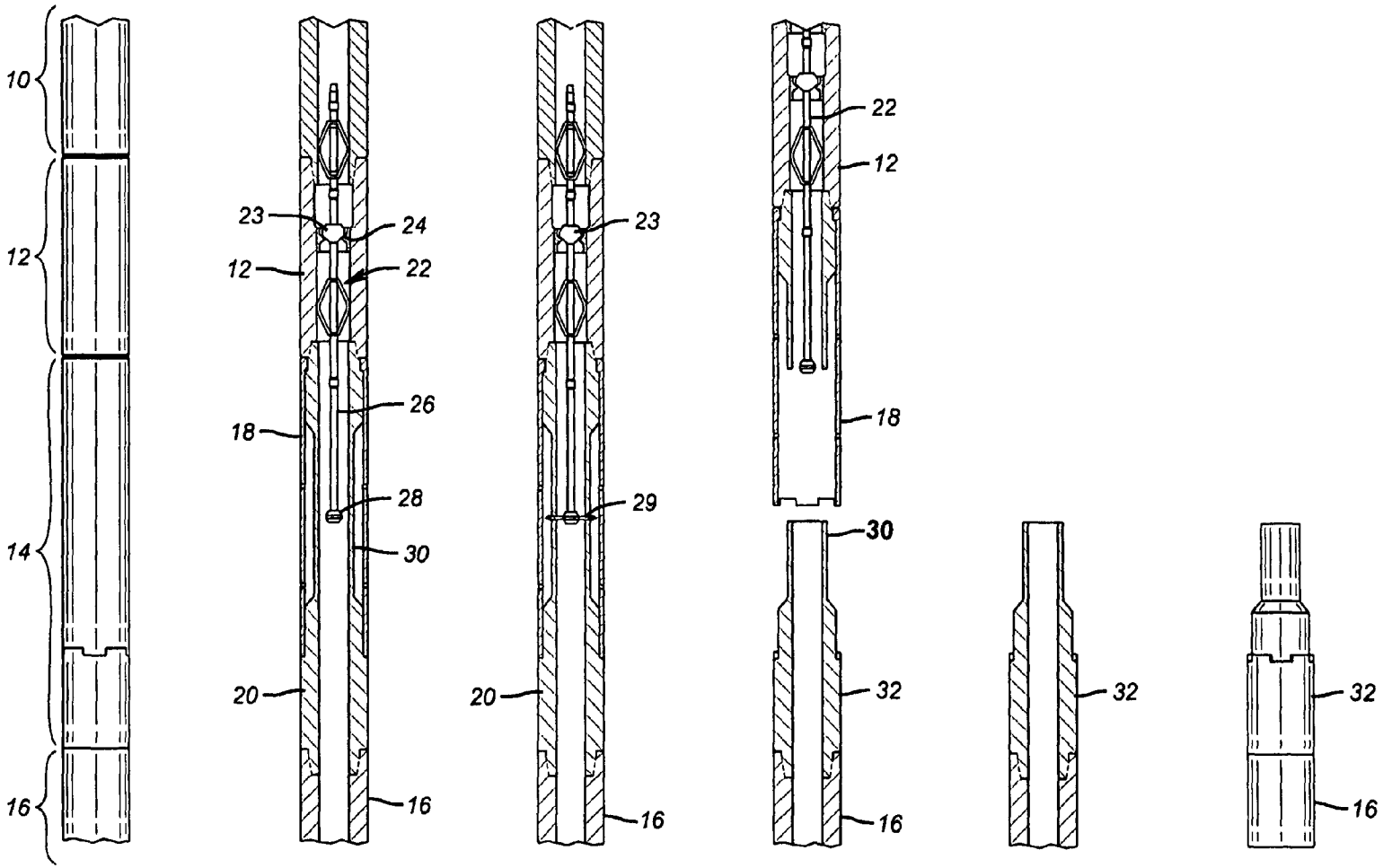
FIG. 1A illustrates a section of pipe string having two sub units inserted between a upper pipe section and a lower pipe section.
FIG. 1B is a sectioned view of FIG. 1A showing a drop assembly within the pipe string in pipe cutting position.
FIG. 1C is a sectioned view of FIG. 1A showing the discharge of a jet cutting tool against a reduced wall annulus section of the sacrificial mandrel.
FIG. 1D is a sectioned view of the severed pipe section of FIG. 1C showing withdrawal of the upper pipe section from the severed lower pipe section.
FIG. 1E is a sectioned view of the severed pipe stub remaining below the cut of FIG. 1C.
FIG. 1F is a full profile view of the severed stub remainder of the pipe section.

A basic utility of the present invention, as practiced, for example, upon a drill string cutting operation, is represented by the six views, A through F of FIG. 1. The FIG. 1A view shows an assembly of the basic downhole pipe string components between an upper section 10 and a lower section 16. An expanded description of each of these constituent components will follow hereafter.

The FIG. 1A illustration is usually most relevant to that heavyweight section of drill pipe 16 at the bottom end of a drill string having joints of pipe with extremely thick wall annuli. To the well driller's art, these pipe joints with exceptionally thick walls are known as "drill collars". A seating sub 12 and cutaway sub 14 may be positioned at the upper end of the collar section or at any intermediate point or at numerous points below the upper end. However, those of ordinary skill will understand that the principles described herein with respect to drill collars are applicable to any form or application of pipe or tube.

Referring to the sectioned view of FIG. 1B, an independent drop assembly 22 is released at the surface to be driven by pump pressure or to descend in free-fall along the pipe bore to terminate with a seating plug element 23 of the drop assembly 22 coming to rest upon a plug seating aperture 24 in the seating sub 12. A drop assembly extension 26, usually extending below the seating aperture 24 is shown to support a jet cutting pyrotechnic tool such as a thermite or shaped charge explosive 28. The extension 26 length is selected to place the jet cutter 28 within the pipe bore opposite a thin wall section 30 of a sacrificial mandrel 20 portion of the cutaway sub 14.

FIG. 1B illustrates the drop assembly 22 seating plug 23 as firmly resting upon seating aperture 24. As more expansively described by the specification of our U.S. Pat. No. 8,272,441 issued Sep. 25, 2012, fluid pressure within the upper pipe string bore is increased to open a firing head valve disposed within the drop assembly 22. Opening the firing head valve initiates the jet cutter 28 ignition sequence to discharge a high temperature cutting jet along cutting plane 29 against the thin wall section 30 of the sacrificial mandrel 20 as represented by FIG. 1C.

With the thin wall section 30 of the sacrificial mandrel 20 severed, FIG. 1D shows the seating sub 12 and torque sleeve 18 portions of the upper pipe string 10 as free to separate from the sacrificial mandrel stub 32 which remains fixed to the well bottom. FIG. 1E shows the sacrificial mandrel stub 32 portion of the cutaway sub 14 in section as remaining with the well bottom pending further, independent action of recovery or well abandonment. FIG. 1F shows the mandrel stub 32 in full profile.

Figure 2A:
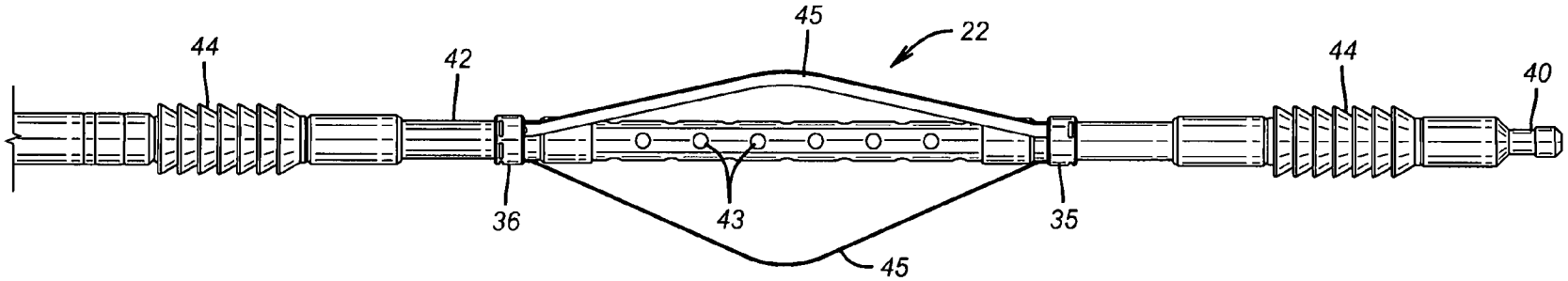
FIG. 2A is an elevation view of the upper portion of a first invention embodiment.
Figure 2B:
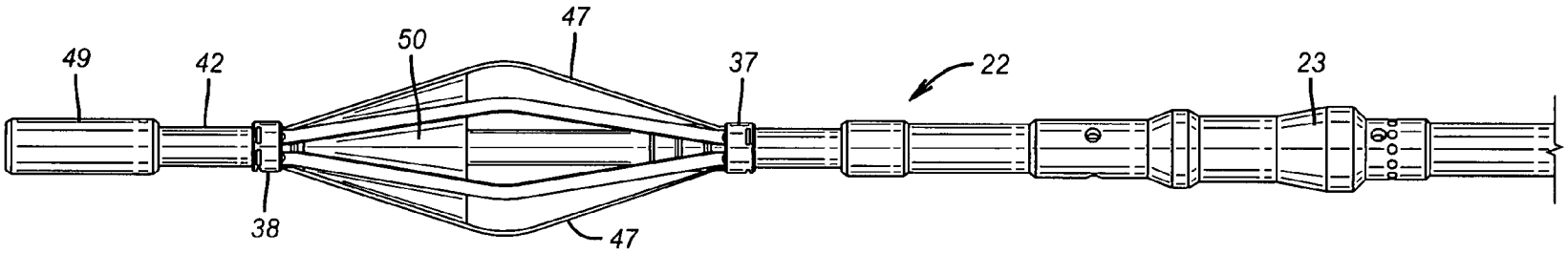
FIG. 2B is an elevation view of the lower portion of the first invention embodiment.

In detail, the drop sub embodiment 22 illustrated by FIGS. 2A and 2B comprises a stem tube 42 that is terminated at its upper distal end by a wireline connecting pin 40 for wireline retrieval. Apertures 43 through the stem tube wall open the internal bore of the stem tube to the surrounding environment. Wiper sets 44 may be positioned above and below the apertures. Arching over the apertures 44 as surface elements of a bowl are a plurality of bore centering spring leaves 45. The spring leaves 45 arch between collars 35 and 36 in the manner of a resilient cage surrounding the stem tube 42. The collars surround the stem tube 42 and secure the spring leaves radially to the stem tube. However, at least one of the collars 35 and 36 is substantially free to axial displacement along the surface of the stem tube. The opposite distal ends of each spring leaf are secured to a respective one of the collars 35 and 36.

Figure 6:
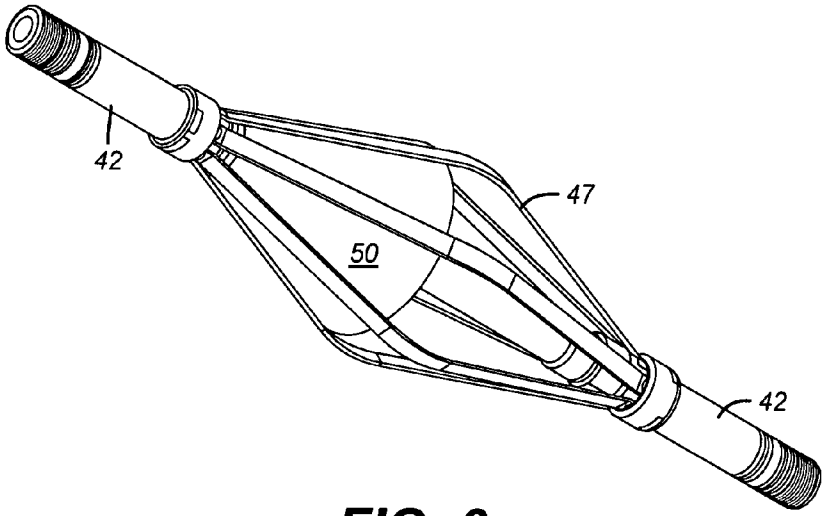
FIG. 6 is a partially sectioned view of the invention canopy section.
Figure 5:
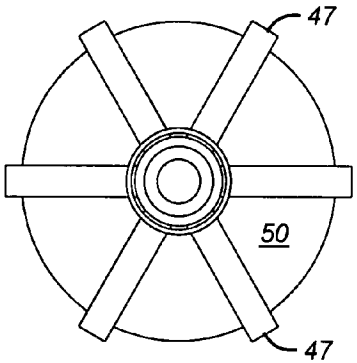
FIG. 5 is an end view of the invention canopy section.

Referring to FIG. 2B, a seating plug 23 is shown to be positioned below the apertures 44 and spring leaves 45. Below the seating plug 23, is a lower set of centering spring leaves 47. As in the case of the upper spring cage, the distal ends of spring leaves 47 are secured to axially sliding collars 37 and 38. A coupling 49 terminates the lower distal end of the stem tube 42. Well treatment and operational tools such as a jet cutter 29 assembly may be secured to the coupling 49. An axial bore through coupling 49 is in fluid communication with the stem tube apertures 43 for actuation of the attached operational tool As illustrated by FIGS. 5 and 6, within the cage of centering springs 47 is a cone 50 of flexible, fluid barrier material. Axial length of the cone 50 extends from a relatively tight attachment of the small, apex end to the outer perimeter of the stem tube 42 to approximately the arc bight of the leaves 47. The large diameter end of said cone is as great or greater than the inside bore of the well pipe string. This large diameter end of the cone 50 is oriented up-hole and may be substantially free of structural attachment to the leaves 47 of the spring cage to collapse and facilitate fluid flow past the cone 50 when in bore free fall. However, when the movement of pipe bore fluid is directed against the upper, larger end of the cone 50, the cone opens to function as a piston for driving the sub 22 along the pipe bore.

Fluid supplies into most deep well service operations are provided by positive displacement pumps that discharge a known volume of fluid for each revolution or cycle of the pump. This known discharge volume into the closed volume of a downhole pipe 10 bore may be translated to a known axial displacement distance of the drop sub assembly 22 along the pipe 10 length for each pump cycle when the cone 50 within the lower centering spring 47 opens to substantially prevent bypass flow around the cone. Consequently, a well operator may determine the exact position of a drop sub assembly 22 with reasonable precision by simply counting the number of pump revolutions.

As used herein, the term "fluid barrier" to describe the cone 50 fabrication material is to be interpreted in a sense that the well fluid of a specific application does not pass freely through it. Hence, the term must be interpreted in the context of the physical characteristics of the fluid in which it is to be immersed. This would include a range of materials from membranes that are substantially impermeable to water or gas to strong, loosely woven fabrics immersed in a viscous, high gravity drilling mud.

Other preferable material characteristics of cone 50 are such as to readily collapse away from the centering springs 47 when the drop sub assembly 22 is free falling by gravity to permit fluid standing within the pipe 10 bore to bypass the drop sub. Depending upon the well fluid conditions such as pressure, depth, acidity, viscosity density, rheology and other factors, the material may be a polymer impregnated fabric, reinforced rubber, or woven fiberglass as examples.

Although the FIG. 2B embodiment shows the seating plug 23 to be positioned above the cone 50 and centering spring 47, it will be understood that this is not an essential feature of the invention. In certain field circumstances, it will be preferable to position the plug 23 below or downhole from the cone 50 and centering spring 47.

Figure 3A:
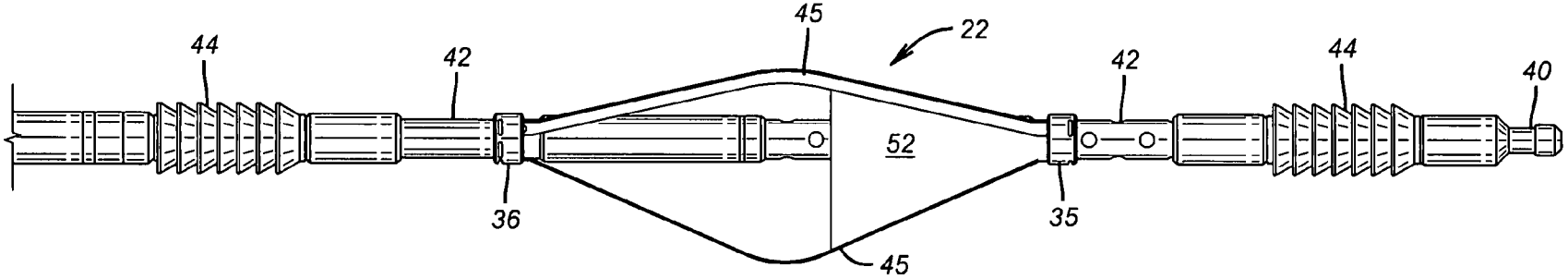
FIG. 3A is an elevation view of the upper portion of a second invention embodiment.
Figure 3B:
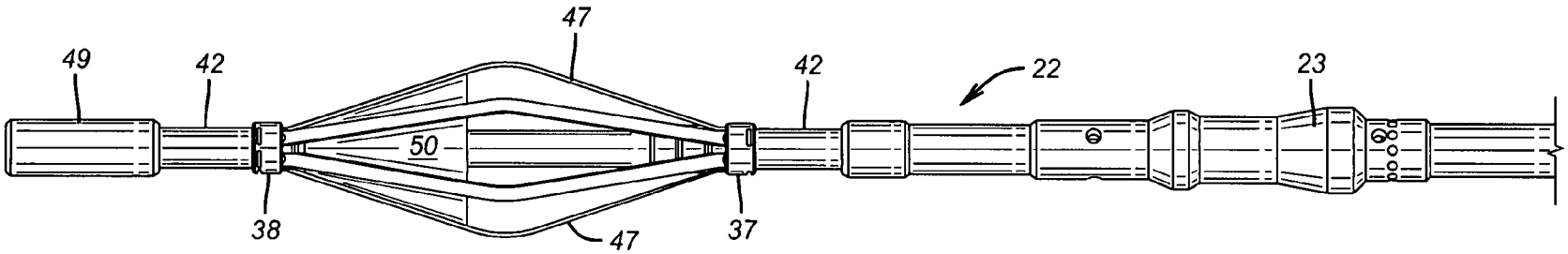
FIG. 3B is an elevation view of the lower portion of a second invention embodiment.
Figure 4:
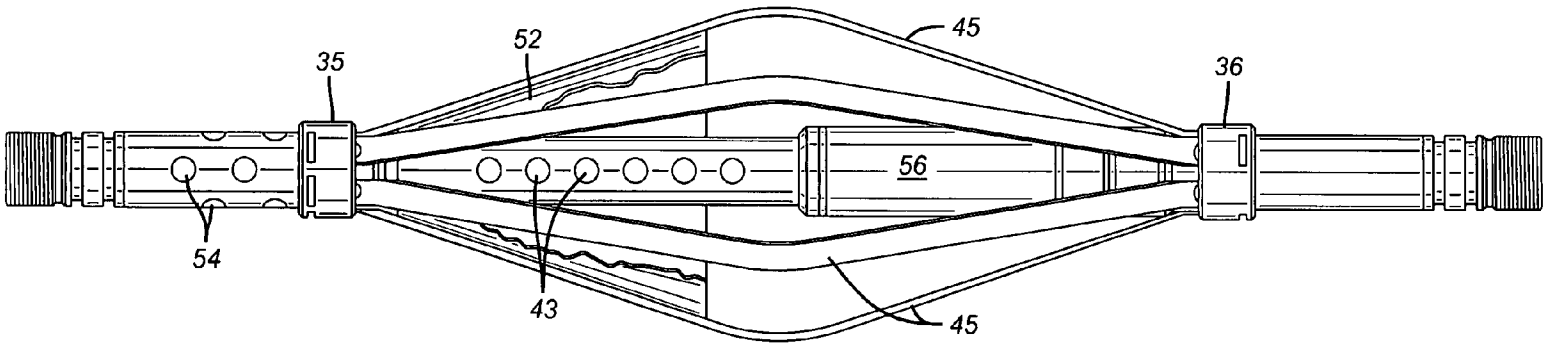
FIG. 4 is a partially sectioned view of a canopy section of the invention

The invention embodiment of FIGS. 3A, 3B and 4 offers another operational utility for the invention by providing a cone 52 within the internal cage of upper centralizer springs 45 independent of or in addition to the lower cone 50 in the cage of spring leaves 47. Cone 52 is oriented with the larger diameter end of the cone below the smaller end. Construction of the cone 52 may be similar to that of the lower cone 50 albeit, not necessarily the same. Operational stress on the cone 50 may be substantially different from that on the lower cone 52.

The cone 52 functions as a brake to retard and slow the gravity driven freefall descent of the drop sub assembly 22. The viscosity and specific gravity of fluid in a pipe pore is highly variable depending on particular well circumstances. In many cases, the fluid may be air or some inert gas, especially in the upper zone of a well, which offers little resistance to the sub assembly descent. Gaseous fluids allow the sub assembly 22 to acquire excessive speed along the pipe string bore thereby jeopardizing the integrity of the attached tool 28 and/or its operation. For example, a severe shock upon landing against the plug seating aperture 24 may prematurely release the fluid pressure actuated firing pin mechanism within pipe stem 42. The cone 52 opens like a parachute to retard the drop sub descent rate.

In the case of the present invention, fluid bypass apertures 54 into the bore of stem tube 42 above the cone 52 cooperate with the valve actuating apertures 43 to provide a restricted fluid flow path past the cone 52 as a descent rate control device. Further control is enabled by a sleeve valve 56 which may be selectively positioned along stem tube to close one or more of the apertures 43.

This combined assembly of FIGS. 3A and 3B permits a regulated freefall descent rate for the drop sub 22 along relatively vertical segments of a pipe 10 bore. Upon entering a more horizontal segment of the well where the gravity forces along the pipe axis are insufficient to drive movement, fluid pressure applied from the surface may collapse the upper cone 52 and expand the lower cone 50 into a ring seal about the internal bore wall of the pipe 10. Additional fluid introduced at the surface to the bore of pipe 10 now displaces the drop sub along the length of pipe 10 without regard to gravity.

As described with respect to the FIG. 2B embodiment, placement of the sealing plug 23 between the cones 50 and 52 as shown by FIG. 3B is not an essential configuration. The plug 23 may also be positioned below the lower cone 50.

It will also be obvious to those of ordinary skill that the materials used for the construction of cones 50 and 52 need not be the same nor even similar. There may be considerable differences in operational stress imposed on the respective cones.

While the foregoing description has focused on the preferred embodiments of the invention as for controlling the placement of free-falling or unattached well tools, it will also be appreciated that the invention principles may be applied to pipe and coiled tubing attached tools. In particular, the piston configuration of the invention embodied in cone 50 may be effectively engaged to draw a long string of coiled tubing along a horizontal segment of deviated well.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A free falling well tool comprising a pipe section having at least a pair of pipe section centralizing cages, one above the other along an axial length of said pipe section, each of said cages comprising a plurality of bowed spring elements distributed around said pipe section, said bowed spring elements having opposite distal ends secured adjacent surface elements of said pipe section, a substantial cone of flexible material disposed within and around said cage between surface elements of said pipe section and a bight portion of said cage with an apex end of one cone oriented in an up-hole direction and an apex end of another cone oriented in the down hole direction, a wall of said pipe section being penetrated by apertures therein above and below said one cone apex.

2. The free falling well tool as described by claim 1 comprising a well pipe bore seating plug disposed about said pipe section surface elements between said cages.

3. The free falling well tool as described by claim 1 comprising a seating plug disposed about said pipe section surface in a down-hole direction from the apex end of said other cone.

4. The free falling well tool described by claim 1 comprising an axially displaced sleeve around said pipe section between said cages to close a designated number of said apertures.

5. A downhole well tool comprising a stem tube having an axial bore therein, an operational tool coupling at one distal end of said stem tube and a wireline connector at an opposite distal end, apertures through a wall of said stem tube proximate said wireline connector, a pipe bore seating plug circumscribing said stem tube; a cage of bowed spring leaves secured around said stem tube proximate said apertures; and a substantial cone of flexible material disposed around said stem tube within said cage, an apex end of said cone converging toward said opposite distal end and secured to said stem tube wall, a first portion of said apertures penetrating said stem tube wall between said one distal end and said cone apex and a second portion of said apertures penetrating said stem tube wall between said opposite distal end and said cone apex.

6. The downhole well tool as described by claim 5 comprising an axially sliding sleeve around said stem tube wall proximate said apertures to close a designated number of said apertures.

7. The downhole well tool as described by claim 5 wherein said cage of spring leaves arches over said second portion of apertures.

8. The downhole well tool as described by claim 5 wherein said seating plug is more proximate said opposite distal end from said cage.

9. The downhole well tool as described by claim 5 further comprising a second cage of bowed spring leaves secured around said stem tube between said first cage and said one distal end, a second substantial cone of flexible material disposed around said stem tube within said second cage, an apex end of said second cone converging toward said one distal end and secured to said stem tube wall.

10. The downhole well tool as described by claim 9 comprising an axially sliding sleeve around said stem tube wall proximate said apertures to close a designated portion of said apertures.

11. The downhole well tool as described by claim 9 wherein said first portion of said apertures penetrates said stem tube wall between said second cage and said apex end of said cone.

12. The downhole well tool as described by claim 9 wherein said cage of spring leaves arches over said first portion of said apertures.

13. The downhole well tool as described by claim 9 wherein said seating plug circumscribes said stem tube between said cage and said second cage.

14. The downhole well tool as described by claim 9 wherein said seating plug circumscribes said stem tube between said second cage and said one distal end.

* * * * *